United States Patent [19]

Nowack et al.

[11] 4,151,072

[45] Apr. 24, 1979

[54] RECLAIMING USED LUBRICATING OILS

[75] Inventors: Gerhard P. Nowack; Donald C. Tabler; Marvin M. Johnson, all of Bartlesville, Okla.

[73] Assignee: Phillips Petroleum Company, Bartlesville, Okla.

[21] Appl. No.: 838,773

[22] Filed: Oct. 3, 1977

Related U.S. Application Data

[63] Continuation-in-part of Ser. No. 797,212, May 16, 1977, abandoned.

[51] Int. Cl.[2] ..... C10M 11/00

[52] U.S. Cl. ..... 208/182; 208/251 R; 208/251 H

[58] Field of Search ..... 208/179, 182, 183, 184, 208/251 R, 251 H

[56] References Cited

U.S. PATENT DOCUMENTS

| | | | |
|---|---|---|---|
| 3,791,965 | 2/1974 | Fitzsimons et al. | 208/179 |
| 3,879,282 | 4/1975 | Johnson | 208/179 |
| 3,930,988 | 1/1976 | Johnson | 208/89 |

*Primary Examiner*—Herbert Levine

[57] ABSTRACT

An integrated process universally applicable for the reclaiming of used lubricating oils, regardless of the contaminants or previous additive systems contained therein, is provided to produce an intermediate low-ash oil or a high-grade lube oil stock which comprises (a) contacting the used oil with an aqueous ammonium salt treating agent, (b) removing a major portion of water, (c) separating the oil phase from the resulting residual product, (d) subjecting the resulting separated oil to hydrotreating and thereafter (e) stripping the resulting hydrotreated lube oil stock. Optionally the low-ash product of step (c) can be recovered for use as a fuel oil, in grease formulations, or in the preparation of some types of lubricating oil formulations.

12 Claims, 2 Drawing Figures

RECLAIMING USED LUBRICATING OILS

Figure 1:
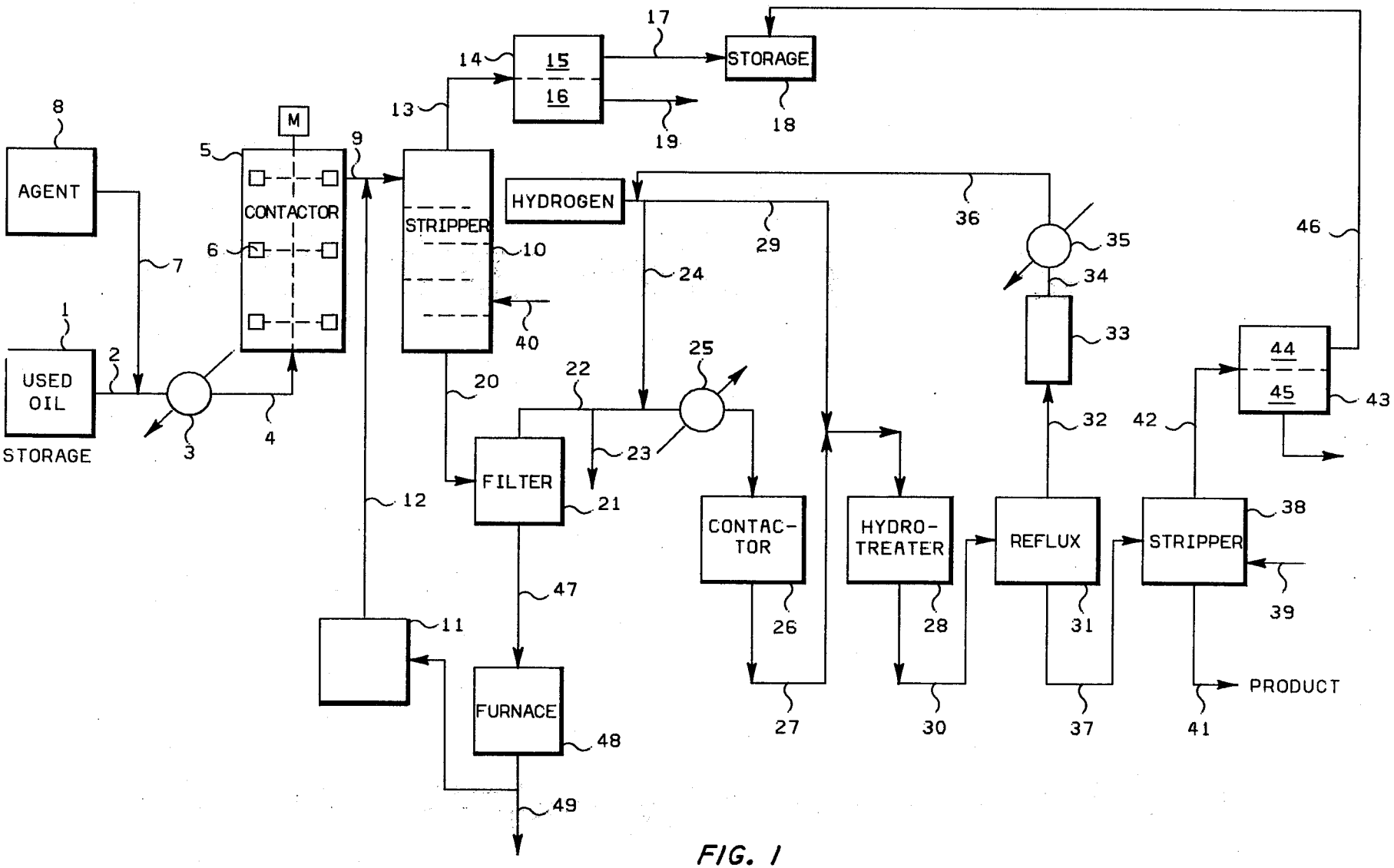

This application is a continuation-in-part of Ser. No. 797,212, filed May 16, 1977, now abandoned.

This invention relates to treatment of used lubricating oils.

In one of its aspects this invention relates to the removal of impurities of used lubricating oils. In another of its aspects this invention relates to the removal of additive systems from used lubricating oils so as to provide a lube oil stock. In still another aspect of the invention it relates to the removal and separation of such specific contaminants as gasoline, metal components, and nitrogen, sulfur and oxygen compounds in a process for treating used lubricating oils.

In one of its embodiments this invention relates to the reduction or removal of contaminants from a used lubricating oil by a series of treatments of the used lubricating oil.

In another embodiment of this invention, oil purified by the overall integrated process of this invention is suitable for use as a high-grade lube oil stock which can be employed in the production of high-grade lubricating oil.

BACKGROUND OF THE INVENTION

In recent years more and more additives such as detergents, pour point depressants, oxidation inhibitors and viscosity index improvers have been employed in petroleum lubricating oils. While these additives have greatly improved the performance of the lubricating oils, they have also greatly increased the task of reclaiming such oils after use. More particularly, resins that normally form in the oil while in use, as well as carbon, dirt, wear metals and other impurities, remain suspended in the oil in the engine by means of modern detergent additives, such as calcium and barium salts of alkyl benzene sulfonic acids, and ashless type detergents, such as alkyl-substituted succinimides. Eventually the suspended impurities are thus largely eliminated from the engine during oil changes and remain within the drained oil.

The economic removal of impurities from used high-detergent lubricating oils, so that the oil may be reused, has proven to be no small task for the reclaimer and is becoming increasingly difficult as more effective detergents are being added to the oils.

Moreover, the modern additive systems have presented a further problem in that such additives must also be removed from the oil stock if the resulting lube oil stock is to be suitable for reformulation to a high-grade lubricating oil.

The purification process used in the past for the separation of carbon and dirt particles from lubricating oils containing no or relatively ineffective detergent additives cannot be satisfactorily used to purify today's high-detergent oils. Since nearly all mineral lubricating oil used today is of the high-detergent variety containing numerous additives, and since service stations tend to place all crankcase drainings into a common tank, practically all used lubricating oil available for re-refining or reclaiming processes has high-detergency properties.

It is an object of this invention to provide a universally applicable system for reclaiming used lubricating oils.

Another object of this invention is to provide an integrated process for reclaiming a high-purity lube oil stock from high-detergent-containing used lubricating oils.

A further object of this invention is to provide an improved process for removing both additives and solid contaminants from used lubricating oils.

Figure 2:
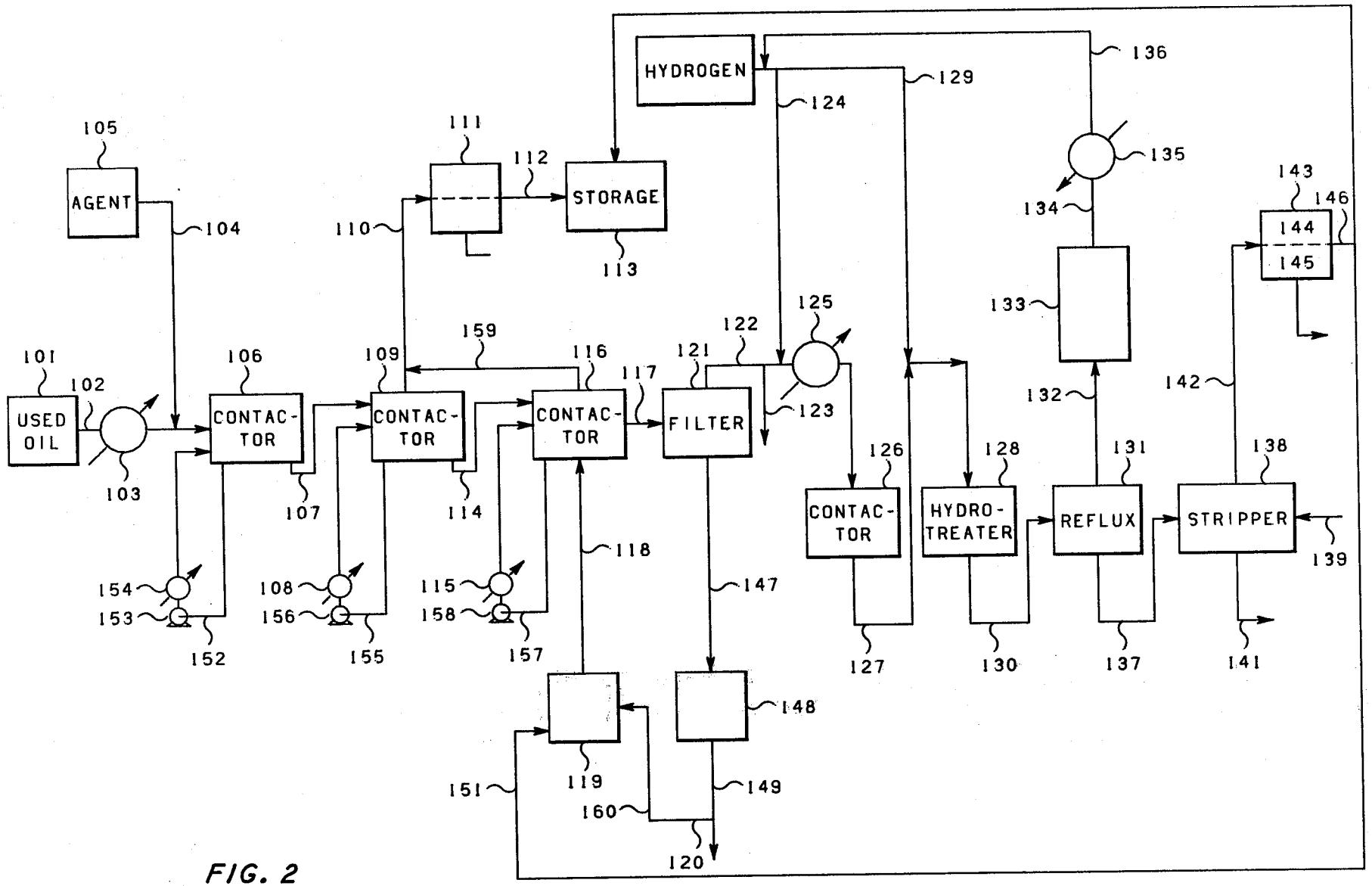

Other aspects, objects and the several advantages of this invention will be apparent to one skilled in the art upon study of the disclosure, the claims and the drawings, of which FIGS. 1 and 2 are schematic representations of the process of the invention.

In accordance with one embodiment of this invention, an integrated process is provided which is universally applicable to all used lubricating oils in which the used lubricating oil is contacted with an aqueous solution of an ammonium salt treating agent. Following reaction of the treating agent with ash-forming contaminants of the oil, the bulk of the water phase is removed from the resulting mixture along with any light hydrocarbon, such as gasoline, in the oil. The resulting oil phase is then separated, preferably by filtration, and thereafter subjected to hydrotreating and stripping whereby there is provided a high-grade lube oil stock free of both solids and additive systems. The light hydrocarbon and water mixture is cooled and allowed to separate into a light hydrocarbon and a water layer. The hydrocarbon layer is then pumped to storage and the water layer can be reused in the system.

In accordance with another embodiment of this invention, a method for reducing the ash content of used lubricating oil is provided in which the used oil is contacted with an aqueous solution of an ammonium salt treating agent under conditions such that the ammonium salt treating agent will react with ash-forming metal components present in and entrained in the used oil. Following removal of essentially all of the water and light hydrocarbons present in the reaction mass, the resulting mixture, being essentially free of water, is then separated to provide an oil phase substantially reduced in ash-producing contaminants.

More specifically, in accordance with one embodiment of this invention we have discovered a universally applicable process for removing solid or ash-forming contaminants from used lubricating oils so as to provide an essentially ash-free oil suitable for various industrial purposes which comprises (a) contacting the used lubricating oil with an aqueous solution of a treating agent consisting essentially of an ammonium salt under conditions of temperature, pressure and time sufficient to disperse the agent in the used lubricating oil and to react the agent with the ash-forming components of the used oil; (b) removing a major portion of water from the resulting mixture of used lubricating oil and treating agent from step (a); (c) separating the oil phase from the residual mixture resulting from step (b) and thereafter recovering the resulting oil phase as a product of the process.

In accordance with another embodiment of the present invention, we have discovered a universally applicable integrated process for the reclaiming of essentially all used lubricating oils regardless of the initial additive system contained therein which comprises (a) contacting the used lubricating oil with an aqueous solution of a treating agent consisting essentially of an ammonium salt under conditions of temperature, pressure and time sufficient to disperse the agent in the used lubricating oil and to react the agent with ashforming components of the used oil; (b) removing a major portion of water from the resulting mixture of used lubricating oil and treating agent from step (a); (c) separating the oil phase from the mixture resulting from step (b); (d) subjecting the oil phase to hydrotreating in the presence of hydrogen and a hydrotreating catalyst under conditions of temperature and pressure and time sufficient to produce a hydrotreated oil stock; (e) stripping the resulting hydrotreated oil in a stripping zone and thereafter recovering the resulting hydrotreated lube oil stock as a product of the process.

The used lubricating oils treated by the process of this invention are primarily the discarded oils that have been used for internal combustion lubrication purposes such as crankcase oils, e.g., in gasoline engines or diesel engines. Other sources of used oils include steam-turbine oils, transmission and gear oils, steam-engine oils, hydraulic oils, heat-transfer oils and the like.

The oils used for the purposes named above are the refined lubricating cuts from paraffin-base, mixed-base, or naphthenic crudes. Their viscosities are generally in the range of from about 100 to about 1,800 SUS at 100° F. The oils also contain various additives such as oxidation inhibitors (e.g., barium, calcium and zinc alkyl thiophosphates, di-t-butyl-p-cresol, etc.), antiwear agents (e.g., organic lead compounds such as lead diorganophosphorodithioates, zinc dialkyldithiophosphates, etc.), rust inhibitors (e.g., calcium and sodium sulfonates, etc.), dispersants (e.g., calcium and barium sulfonates and phenoxides, etc.), viscosity index improvers (e.g., polyisobutylenes, poly-(alkylstyrenes), etc.), detergents (e.g., calcium and barium salts of alkyl benzene sulfonic acids) and ashless-type detergents such as alkyl-substituted succinimides, etc.

If desired, water entrained in the untreated used lubricating oil can be removed before use of same in the process of this invention. Such a separation can be readily achieved by removal of the water phase which may occur in the storage tanks for the used lubricating oil.

The ammonium salt treating agents which are useful in the process of the present invention are those selected from the group consisting of ammonium sulfate, ammonium bisulfate, ammonium phosphate, diammonium hydrogen phosphate, ammonium dihydrogen phosphate, as well as mixtures thereof.

In addition, if desired, precursors of said ammonium salts can be employed instead of part or all of the ammonium salt. Some examples of said precursors include ammonium thiosulfate, ammonium polyphosphates such as ammonium metaphosphate, urea sulfate, guanidine sulfate, urea phosphate, and guanidine phosphate. Other applicable precursors include reactive combinations of ammonia and/or ammonium hydroxide with sulfuric acid and/or phosphoric acid and/or an ammonium hydrogen sulfate or phosphate, i.e., ammonium bisulfate, diammonium hydrogen phosphate, and/or ammonium dihydrogen phosphate. When the precursor comprises a combination of such components reactive with each other to give the desired salt in situ, the components of the combination can be introduced at the same time, or either component can be added prior to the introduction of the other component.

Although the concentration of treating agent in the aqueous solution of treating agent is not critical and more dilute solutions can be used, the economics of the process are enhanced by the use of relatively concentrated solutions in order that the amount of water to be removed subsequently will not be great. Generally the concentration of treating agent in the aqueous solution will be within the range of about 30 to about 95 weight percent, typically about 80 weight percent, of that in an aqueous solution at 25° C. saturated with the treating agent. Frequently some water will be found in used oil, and in these instances the concentration of the treating agent can be adjusted accordingly.

In the process of this invention, the treating agent should be employed in an amount at least sufficient to react with all of the metal constituents in the used oil. Although the weight ratio of the treating agent to the used oil can vary greatly, depending in part upon the nature and concentration of metal-containing components in the oil and on the particular treating agent employed, generally it will be within the range of about 0.002:1 to about 0.05:1, most often being within the range of about 0.005:1 to about 0.015:1, and typically being about 0.01:1. Although larger amounts of treating agent can be used, in most instances this would be wasteful of treating agent.

To illustrate further the overall process of the present invention, the following descriptions are provided which, taken in conjunction with the attached drawings which are schematic representations of the process, set forth the presently preferred modes of operation.

Referring now to FIG. 1, used oil from storage tank 1 is passed via line 2 to heater 3. Aqueous treating agent containing diammonium hydrogen phosphate from makeup tank 8 is introduced via line 7, in an amount in slight excess of that required to react with the ash-forming constituents in the used oil, into admixture in line 2. Following heating in heater 3, the resulting hot admixture of oil and treating agent is passed via line 4 into a contactor 5 wherein sufficient agitation is provided, such as by the action of paddles 6, to assure thorough dispersion of the aqueous treating agent into the oil phase of the mixture introduced into the stirred contactor 5. While it is presently preferred that the aqueous treating agent be added upstream of heater 3 due to the relatively small volume of agent being employed, the aqueous treating agent can be added either downstream of heater 3 into conduit 4 or directly to the contactor 5.

The admixture of used oil and aqueous treating agent is maintained in contactor 5 for a period of time and under conditions of temperature and pressure sufficient to effect reaction of the treating agent with essentially all of the ash-forming components present in the used oil.

Following adequate reaction of the ash-forming components in the hot oil with the treating agent, the resulting reaction mass having a continuous oil phase is passed via conduit 9 to the upper portion of stripper 10. In one embodiment of the invention, prior to the entry of the emulsion to stripper 10, a slurry of a filter aid in oil or in light hydrocarbon, e.g., from phase 44, can be added to the system from makeup tank 11 via line 12.

Filter aids which are useful in the practice of the process of this invention are those selected from the group consisting of diatomaceous earth, perlite, and cellulose fibers. Presently preferred is diatomaceous earth.

In one embodiment of the invention, the upper end of stripper 10 is maintained at a temperature and a pressure sufficient to effect flash distillation of the bulk of the water and light hydrocarbon components of the mixture, which are thereafter removed and passed via line 13 to phase separator 14 wherein a hydrocarbon layer 15 and a water layer 16 are allowed to form. The hydrocarbon layer can then be transferred via line 17 to storage 18. The water layer 16 can be removed via line 19 and discarded or employed for any desired purpose, such as, for example, use in a stream boiler.

The resulting residual mixture, which has a sulfated ash value of about 0.3 to about 10 weight percent (ASTM D 847-72) exclusive of any filter aid or excess treating agent present, comprising a hot oil phase which is essentially free of water but which has excess treating agent, some residual water, and filter aid, if used, in addition to the ash-forming solids originally present in or derived from the used oil, is passed downwardly through stripper 10.

While not required, it is presently preferred that while the oil is still at an elevated temperature, steam is introduced via line 40 to stripper 10 to assist in removal of light components and residual water from the system. Thereafter, the resulting stripped hot oil is passed via line 20 to filter 21 to remove suspended and entrained ash-forming matter.

While a filter aid can be added to the emulsion prior to stripping, as described above, to assist in the subsequent separation of the solids from the essentially water-free oil phase, it is preferable that the filter 21 be precoated with a filter aid selected from those named above and applied directly to the filter. If desired, the filter aid can be used both to add to the emulsion prior to stripping and to precoat the filter.

In the presently preferred embodiment of the invention, filter cake from filter 21 is removed via line 47 and optionally passed to furnace 48 from which, following burning or calcination, the resulting ash comprising diatomaceous earth can be passed to waste via line 49 or recycled to slurry makeup tank 11 for further use in the system.

The filtered oil, being essentially free of ash-forming constituents previously contained therein, i.e., now having a sulfated ash value of about 0.01 to about 0.3 weight percent (ASTM D 847-72) exclusive of excess treating agent or any filter aid which inadvertently might have passed through the filter, is suitable for a variety of industrial uses such as fuel oils without further treatment in accordance with the integrated overall process of this invention. For example, the used oil at this point in the overall treating system of the invention can be used as a fuel oil, in grease formulations or in the preparation of some types of lubricating oil formulations. When so desired, the oil can be removed from the system via line 23.

However, in the presently preferred integrated process of this invention, the hot oil following filtration is passed via line 22 to heater 25 so as to raise the oil to a temperature in the range of 200°-480° C. If desired, a first portion of hydrogen is added thereto via line 24. The resulting hot oil having added hydrogen therein is then passed through contactor 26 wherein decomposition is effected of the sulfonates contained in the oil.

While it is presently preferred that contactor 26 contain bauxite or an activated carbon adsorbent bed therein, this unit can employ other adsorbents such as those selected from the group consisting of silica gel, clay, activated alumina, combinations thereof, and the like. The adsorbent serves to effect breakdown and decomposition of the ammonium salts of sulfonic acids and the ashless detergents contained in the oil. The adsorbent further serves to collect a small portion of the resulting products and thus precludes passage of such undesirable decomposition products to the hydrotreater. Such adsorbents can be regenerated by conventional means and reused.

While less preferred, it is also possible to omit contactor 26 and to remove the small amount of ash components and highly polar materials present in the low-ash, filtered oil by heating the oil to a temperature within the range of about 300°-410° C., e.g., about 380° C., in the presence of hydrogen and an adsorbent suspended in the oil. After such treatment, the oil is cooled to a temperature within the range of about 60°-200° C., e.g., about 150° C., and refiltered. The same adsorbents cited above for use in fixed contactors are suitable for this contact-treating process and give similar results.

Preferably, the adsorbent contains about 0.2 to about 20 weight percent of at least one metal selected from the group consisting of Group VIB and Group VIII metals, this weight percent being based on the total weight of modified adsorbent. This modified adsorbent can be and often preferably is prepared by impregnation of the adsorbent with an aqueous solution of a water-soluble compound of a Group VIB or Group VIII metal, followed by evaporation of water. Water-soluble compounds presently preferred for this use are iron compounds such as ferric ammonium oxalate, ferric ammonium citrate, ferric sulfate, and ferrous ammonium sulfate.

The resulting treated oil is thereafter passed from contactor 26 via line 27 to hydrotreater 28, which is maintained at an elevated temperature, which serves to effect destruction of various additive systems previously added to the original oil stock. Hydrogen for the desired hydrotreating reaction is introduced to the system via line 29 in communication with line 27 or, if desired, directly to the hydrotreater 28.

In hydrotreater 28 the oil is subjected to hydrogenation conditions in the presence of a catalyst sufficient to remove unwanted compounds and unsaturated materials and to effect decomposition of residual sulfur, oxygen and nitrogen bodies so as to yield an oil product suitable for further purification to a lube stock.

Suitable catalysts for use in hydrotreater 28 are those selected from the group consisting of Group VIB and Group VIII metals and combinations thereof, on a refractory support, used in conventional hydrodesulfurization processes.

Following hydrotreating, the resulting oil is passed via conduit 30 to separator-reflux column 31 which serves to remove water and various other by-products of the previous treatments from the oil. If desired, and particularly when HCl is present, water can be injected into column 31 to aid in removal of most of any HCl and part of the $H_2S$ and $NH_3$ as water-soluble salts. Overhead from column 31 comprising hydrogen, $H_2S$, $NH_3$, and water is passed via line 32 to sulfur removal unit 33. This unit, for example a bed of zinc oxide, serves to remove $H_2S$ (sulfur) from the hydrogen stream. The resulting sulfur-free hydrogen stream is thereafter passed via line 34 to cooler 35. Ammonia is then removed, for example by water washing in an ammonia removal unit (not shown) in conduit 36. Hydrogen is then recycled via conduit 36 to line 29.

An example of another material useful in unit 33 is iron oxide. Alternatively, a solvent process can be employed using substances such as alkanolamines and/or other amines, the $H_2S$ being subsequently oxidized to sulfur in a Claus-type process.

The bottoms product from column 31 is passed via line 37 to lube-stock stripper 38 wherein a further steam treatment is carried out by introduction of steam via line 39.

Stripping, preferably steam stripping, of the oil is essential to the integrated process of this invention since it serves to remove those light hydrocarbon products boiling below the oil, such as kerosene or heavy gasoline, which have remained entrained in the oil or which are by-products of the hydrogenation treatment. Alternatively, gas stripping such as with hydrogen can be employed.

The resulting hot stripped product, consisting essentially of a pure lube oil stock, following cooling such as by use in heat exchanger 25, is thereafter passed via line 41 to a lube oil stock product tank (not shown) for storage and subsequent use as an additive-free lube oil stock suitable for reformulation with additives as desired.

Overhead from stripper 38, which consists essentially of fuel oil and water, is passed via line 42 to settler 43, where a hydrocarbon phase 44 and a water layer 45 are allowed to form. The hydrocarbon layer 44 is removed via line 46 and combined, if desired, with the hydrocarbon phase in storage tank 18 for further use. The small amount of gases present in line 46 can be removed by flashing.

Depending upon the feedstock, treating agent and other characteristics of a particular operation, as one skilled in the art in possession of this disclosure will understand, the specific conditions of operation given below can vary, preferably within the approximate ranges which are also given.

| Fig. 1 Ref. No. | Unit Description | Calculated Operation: Typical | Approximate Preferred Ranges |
|---|---|---|---|
| 3 | Heater | Temperature 160° C.<br>Pressure 215 psia | 60°-200° C.<br>atmospheric-250 psia |
| 7 | Treating Agent | Weight ratio agt:oil 0.01:1 | 0.005:1-0.05:1 |
| 5 | Contactor | Temperature 160° C.<br>Pressure 215 psia<br>Time 30 minutes | 60°-200° C.<br>atmospheric-250 psia<br>10 minutes-2 hours |
| 10 | Stripper | Top<br>Temperature 160° C.<br>Pressure 16 psia<br>Bottom<br>Temperature 115° C.<br>Pressure 16 psia | <br>60°-200° C.<br>20-2 psia<br><br>60°-200° C.<br>20-2 psia |
| 14 | Phase Separator | Temperature 40° C.<br>Pressure atmospheric | 0°-80° C.<br>atmospheric-45 psia |
| 21 | Filter | Temperature 115° C.<br>Pressure differential<br>Plate and frame filter 80 psi<br>Continuous rotary drum filter 10 psi | 60°-200° C.<br><br>5-100 psi<br>2-14 psi |
| 48 | Furnace | Temperature 760° C.<br>Pressure atmospheric | 650°-870° C.<br>substantially atmospheric |
| 12 | Filter Aid | Weight ratio aid:oil 0.01:1 | 0:1-0.15:1 |
| 24 | Hydrogen Charge | 111 vol/vol oil | 80-3000 vol/vol oil |
| 25 | Heater | Temperature 370° C.<br>Pressure 735 psia | 200°-480°0 C.<br>150-3000 psia |
| 26 | Contactor | Temperature 370° C.<br>Pressure 735 psia | 200°-480° C.<br>150-3000 psia |
| 28 | Hydrotreater | Temperature 360° C.<br>Pressure 730 psia | 200-430° C.<br>150-3000 psia |
| 29 | Hydrogen Charge | 222 vol/vol oil | 80-3000 vol/vol oil |
| 31 | Reflux | Temperature 325° C.<br>Pressure 705 psia | 290°-400° C.<br>600-800 psia |
| 33 | Sulfur Removal Unit | Temperature 290° C.<br>Pressure 700 psia | 150°-430° C.<br>100-3000 psia |
| 35 | Cooler | Inlet temperature 290° C.<br>Outlet temperature 55° C. | 260°-370° C.<br>40°-95° C. |
| 38 | Stripper | Temperature 370° C.<br>Pressure 20 psia | 280°-395° C.<br>atmospheric-50 psia |
| 43 | Settler | Temperature 55° C.<br>Pressure 16 psia | 0°-80° C.<br>atmospheric-45 psia |

In the table below there are given typical compositions of the principal streams for the operating conditions above set out.

TABLE I

| Stream No. | 2 | 7 | 9 | 20 | 22 | 24 | 29 | 30 | 32 | 34 | 37 | 42 | 46 | 41 |
|---|---|---|---|---|---|---|---|---|---|---|---|---|---|---|
| | Pounds per Stream Day | | | | | | | | | | | | | |
| Oil | 6644 | | 6644 | 6444 | 6445 | | | 6325 | 32 | 32 | 6293 | 32 | 32 | 6261 |
| 5 Metals plus P* | 51 | | | | | | | | | | | | | |
| S* | 15 | | 13 | 13 | 13 | | | <1 | | | <1 | | | <1 |
| O** | 50 | | 45 | 45 | 44 | | | <1 | | | <1 | | | <1 |
| N* | 10 | | 10 | 10 | 10 | | | <0.1 | | | <0.1 | | | <0.1 |
| $H_2O$ | 417 | 140 | 557 | | | 2 | 2 | 54 | 54 | 61 | | 320 | | |
| $NH_3$ | | | | | | 4 | 4 | 20 | 20 | 20 | | | | |

TABLE I-continued

| Stream No. | 2 | 7 | 9 | 20 | 22 | 24 | 29 | 30 | 32 | 34 | 37 | 42 | 46 | 41 |
|---|---|---|---|---|---|---|---|---|---|---|---|---|---|---|
| | Pounds per Stream Day | | | | | | | | | | | | | |
| $H_2S$ | | | | | | | | 14 | 14 | | | | | |
| Light hydrocarbons | 300 | | 300 | 150 | 150 | | | 275 | 185 | 185 | 90 | 90 | 90 | |
| $(NH_4)_2HPO_4$ | | 70 | | | | | | | | | | | | |
| $CH_4$ | | | | | | 67 | 67 | 137 | 132 | 132 | 5 | 5 | 5 | |
| $H_2$ | | | | | | 66 | 67 | 115 | 114 | 114 | 1 | 1 | 1 | |
| Oil-insolubles | | | 128 | 128 | | | | | | | | | | |
| Diatomaceous earth | | | | 70 | | | | | | | | | | |

*Present in combined form in the used oil.
**Present in combined form in the used oil, excluding $H_2O$.

In another embodiment of this invention as shown in FIG. 2, used oil from storage tank 101 is passed via line 102 to heater 103 and contactor 106. Aqueous treating agent containing diammonium hydrogen phosphate from makeup tank 105 is introduced via line 104. If desired, agent precursors ammonia, phosphoric acid, and water can be introduced into the heated oil downstream of heater 103, thereby forming the treating agent in situ in line 102 and contactor 106. The oil from heater 103 is passed in admixture with treating agent into the first agitated contactor 106 wherein the mixture is maintained under agitation for a time sufficient to react with the ash-forming components in the oil. Preferably, a recycle stream is passed through conduit 152 to pump 153 and then through heater 154 before its return to contactor 106, thereby providing heat and agitation to the contents of the contactor. Stirring means also can be employed.

Thereafter the mixture is passed via conduit 107 to second contactor 109, which is maintained at a temperature in the range of about 110° to about 140° C., for a time sufficient to effect distillation of a major portion of the water and at least some of the light hydrocarbons present therein. Thus, while retained in contactor 109, essentially all of the water and at least a portion of the light hydrocarbon components of the mixture are removed via line 110 and passed to separator 111 wherein a hydrocarbon layer and a water layer are allowed to form. The hydrocarbon phase can then be transferred via line 112 to storage 113. The water layer can be removed and discarded or employed for any desired purpose. Preferably, a recycle stream is passed through conduit 155 to pump 158 and then through heater 108 before its return to contactor 109, thereby providing heat and agitation to the contents of the reactor. Stirring means also can be employed.

The resulting residual mixture comprising a hot oil phase which is essentially free of water is passed via conduit 114 to a third contactor 116 wherein the mixture is admixed with diatomaceous earth which is introduced to contactor 116, preferably as a slurry in light hydrocarbons recovered from the integrated process, via conduit 118 from makeup tank 119. Preferably, a recycle stream is passed through conduit 157 to pump 158 and then through heater 115 before its return to contactor 116, thereby providing heat and agitation to the contents of the contactor. Any residual water and light hydrocarbon components are removed from contactor 116 via line 159.

If desired, any one or two or all of contactors 106, 109 and 116 can be provided with jackets heated by steam or other source of heat to aid in maintaining the contents of the contactors at the desired temperatures. Any one or two or all of contactors 106, 109 and 116 can be equipped with stirrers to provide additional agitation. In an operable but presently less preferred arrangement, a stirrer in any one or more of the three contactors can be used instead of the recycle system employed with the corresponding one or more of the three contactors, any additional heating being provided by heaters in the line ahead of the contactors and/or by heated jackets around the contactors. Furthermore, if desired, the process can be conducted without contactor 116, in which instance the diatomaceous earth can be passed through conduit 118 into conduit 114 from which the resulting mixture comprising oil, solid impurities and diatomaceous earth can be passed directly to filter 121. Also, if desired, any one or two or all of conduits 102, 107 and 114 can feed into the recycle stream for contactors 106, 109 and 116, respectively, i.e., into conduits 152, 155 and 157, respectively, instead of directly into the respective contactor as shown in FIG. 2.

Following admixture of diatomaceous earth, the resulting hot mixture is passed via line 117 to filter 121, which optionally can be precoated with diatomaceous earth. If desired, other filter aids such as perlite or cellulose fibers can be used.

Filter cake from filter 121 is removed via line 147 and optionally passed to furnace 148 from which, following burning or calcination, at least a portion of the resulting ash comprising diatomaceous earth can be passed to waste via line 149 or recycled via conduits 120 and 160 to slurry makeup tank 119 for further use in the system. Fresh diatomaceous earth is added through conduit 160. Light hydrocarbons for use in preparing the slurry can be recovered from the integrated process and can be passed to tank 119 via conduit 151.

In carrying out the process of this embodiment of the invention, a beneficial increase is achieved in the filter rate of the oil through filter 121 when the oil-reagent mix is maintained in admixture for a period of at least 10 minutes at a temperature of 60° to 120° C. prior to further processing.

Thus the hot filtered oil, being essentially free of ash-forming constituents previously contained therein, is suitable for a variety of industrial uses and, if desired, can be removed from the system via line 123.

However, in the presently preferred integrated process of this invention, the hot oil following filtration is passed via line 122 to heater 125 in order to raise the oil to a temperature in the range of 200° to 480° C. for further processing in a manner similar to that shown in FIG. 1. If desired, a first portion of hydrogen is added thereto via line 124. The resulting hot oil containing the added hydrogen is then passed through contactor 126 wherein decomposition is effected of the sulfonates contained in the oil.

While it is presently preferred that contactor 126 contain bauxite or an activated carbon adsorbent bed therein, this unit can employ other absorbents such as those selected from the group consisting of silica gel, clay, activated alumina, combinations thereof, and the like. The adsorbent serves to effect breakdown and decomposition of the ammonium salts of sulfonic acids and the ashless detergents contained in the oil. The adsorbent further serves to collect a small portion of the resulting products and thus precludes passage of such undesirable decomposition products to the hydrotreater. Such adsorbents can be regenerated by conventional means and reused.

While less preferred, it is also possible to omit contactor 126 and to remove the small amount of ash components and highly polar materials present in the low-ash, filtered oil by heating the oil to a temperature within the range of about 300°–410° C., e.g., about 380° C., in the presence of hydrogen and an adsorbent suspended in the oil. After such treatment, the oil is cooled to a temperature within the range of about 60°–200° C., e.g., about 150° C., and refiltered. The same adsorbents cited above for use in fixed-bed contactors are suitable for this contact-treating process and give similar results.

Preferably, the adsorbent contains about 0.2 to about 20 weight percent of at least one metal selected from the group consisting of Group VIB and Group VIII metals, this weight percent being based on the total weight of modified adsorbent. This modified adsorbent can be prepared by impregnation of the adsorbent with an aqueous solution of a water-soluble compound of a Group VIB or Group VIII metal, followed by evaporation of water. Water-soluble compounds presently preferred for this use are iron compounds such as ferric ammonium oxalate, ferric ammonium citrate, ferric sulfate, and ferrous ammonium sulfate.

The resulting treated oil is thereafter passed from contactor 126 via line 127 to hydrotreater 128, which is maintained at an elevated temperature, which serves to effect destruction of the various additive systems previously added to the original oil stock. Hydrogen for the desired hydrotreating reaction is introduced to the system via line 129 in communication with line 127 or, if desired, directly to the hydrotreater 128.

In hydrotreater 128 the oil is subjected to hydrogenation conditions in the presence of a catalyst sufficient to remove unwanted compounds and unsaturated materials and to effect decomposition of residual sulfur, oxygen and nitrogen bodies so as to yield an oil product suitable for further purification to a lube stock.

Suitable catalysts for use in hydrotreater 128 are those selected from the group consisting of Group VIB and Group VIII metals and combinations thereof, on a refractory support, used in conventional hydrodesulfurization processes.

Following hydrotreating, the resulting oil is passed via conduit 130 to separator-reflux column 131 which serves to remove water and various other by-products of the previous treatments from the oil. If desired, and particularly when HCl is present, water can be injected into column 131 to aid in removal of most of any HCl and part of the $H_2S$ and $NH_3$ as water-soluble salts. Overhead from column 131 comprising hydrogen, $H_2S$, $NH_3$, and water is passed via line 132 to sulfur removal unit 133. This unit, for example a bed of zinc oxide, serves to remove $H_2S$ (sulfur) from the hydrogen stream. The resulting sulfur-free hydrogen stream is thereafter passed via line 134 to cooler 135. Ammonia is then removed, for example by water washing in an ammonia removal unit (not shown) in conduit 136. Hydrogen is then recycled via conduit 136 to line 129.

An example of another material useful in unit 133 is iron oxide. Alternatively, a solvent process can be employed using substances such as alkanolamines and/or other amines, the $H_2S$ subsequently being oxidized to sulfur in a Claus-type process.

The bottoms product from column 131 is passed via line 137 to lube-stock stripper 138 wherein a further steam treatment is carried out by introduction of steam via line 139.

Stripping, preferably steam stripping, of the oil is essential to the integrated process of this invention since it serves to remove those light hydrocarbon products boiling below the oil, such as kerosene or heavy gasoline, which have remained entrained in the oil or which are by-products of the hydrogenation treatment. Alternatively, gas stripping such as with hydrogen can be employed.

The resulting hot stripped product, consisting essentially of a pure lube oil stock, following cooling such as by use in heat exchanger 125, is thereafter passed via line 141 to a lube oil stock product tank (not shown) for storage and subsequent use as an additive-free lube oil stock suitable for reformulation with additives as desired.

Overhead from stripper 138, which consists essentially of fuel oil and water, is passed via line 142 to settler 143, where a hydrocarbon phase 144 and a water layer 145 are allowed to form. The hydrocarbon layer 144 is removed via line 146 and combined, if desired, with the hydrocarbon phase in storage tank 113 for further use or recycled to filter aid makeup tank 119 via line 151. The small amount of gases present in line 146 can be removed by flashing.

Depending upon the feedstock, treating agent and other characteristics of a particular operation, as one skilled in the art in possession of this disclosure will understand, the specific conditions of operation given below can vary, preferably within the approximate ranges which are also given.

| | | Calculated Operation | |
|---|---|---|---|
| Fig. 2 Ref. No. | Unit Description | Typical | Approximate Preferred Ranges |
| 103 | Heater | Temperature 95° C.<br>Pressure 17 psia | 60°–120° C.<br>atmospheric-250 psia |
| 104 | Treating Agent | Weight ratio agt:oil 0.01:1 | 0.005:1–0.05:1 |
| 106 | Contactor | Temperature 95° C.<br>Pressure 17 psia<br>Time 30 minutes | 60°–120° C.<br>atmospheric-50 psia<br>10 minutes–2 hours |
| 109 | Contractor | Temperature 125° C.<br>Pressure 16 psia<br>Time 30 minutes | 110°–140° C.<br>5–25 psia<br>10 minutes–2 hours |
| 116 | Contactor | Temperature 160° C.<br>Pressure 16 psia<br>Time 30 minutes | 140°–200° C.<br>5–25 psia<br>10 minutes–2 hours |

-continued

| Fig. 2 Ref. No. | Unit Description | Calculated Operation Typical | Approximate Preferred Ranges |
|---|---|---|---|
| 111 | Phase Separator | Temperature 40° C.<br>Pressure atmospheric | 0°-80° C.<br>atmospheric-45 psia |
| 121 | Filter | Temperature 115° C.<br>Pressure differential<br>Plate and frame filter 80 psi<br>Continuous rotary drum filter 10 psi | 60°-200° C.<br><br>5-100 psi<br>2-14 psi |
| 148 | Furnace | Temperature 760° C.<br>Pressure atmospheric | 650°-870° C.<br>substantially atmospheric |
| 118 | Filter Aid | Weight ratio aid:oil 0.01:1 | 0:1-0.15:1 |
| 124 | Hydrogen Charge | 111 vol/vol oil | 80-3000 vol/vol oil |
| 125 | Heater | Temperature 370° C.<br>Pressure 735 psia | 200°-480° C.<br>150-3000 psia |
| 126 | Contactor | Temperature 370° C.<br>Pressure 735 psia | 200°-480° C.<br>150-3000 psia |
| 128 | Hydrotreater | Temperature 360° C.<br>Pressure 730 psia | 200°-430° C.<br>150-3000 psia |
| 129 | Hydrogen Charge | 222 vol/vol oil | 80-3000 vol/vol oil |
| 131 | Reflux | Temperature 325° C.<br>Pressure 705 psia | 290°-400° C.<br>600-800 psia |
| 133 | Sulfur Removal Unit | Temperature 290° C.<br>Pressure 700 psia | 150°-430° C.<br>100-3000 psia |
| 135 | Cooler | Inlet temperature 290° C.<br>Outlet temperature 55° C. | 260°-370° C.<br>40°-95° C. |
| 138 | Stripper | Temperature 370° C.<br>Pressure 20 psia | 280°-395° C.<br>atmospheric-50 psia |
| 143 | Settler | Temperature 55° C.<br>Pressure 16 psia | 0°-80° C.<br>atmospheric-45 psia |

In the table below there are given typical compositions of the principal streams for the operating conditions above set out.

TABLE II

| Stream No. | Pounds per Stream Day 102 | 104 | 107 | 117 | 122 | 124 | 129 | 130 | 132 | 134 | 137 | 142 | 146 | 141 |
|---|---|---|---|---|---|---|---|---|---|---|---|---|---|---|
| Oil | 6644 | | 6644 | 6644 | 6445 | | | 6325 | 32 | 32 | 6293 | 32 | 32 | 6261 |
| Metals plus P* | 51 | | | | | | | | | | | | | |
| S* | 15 | | 13 | 13 | 13 | | | <1 | | | <1 | | | <1 |
| O** | 50 | | 45 | 45 | 44 | | | <1 | | | <1 | | | <1 |
| N* | 10 | | 10 | 10 | 10 | | | <0.1 | | | <0.1 | | | <0.1 |
| $H_2O$ | 417 | 140 | 557 | | | 2 | 2 | 54 | 54 | 61 | | 320 | | |
| $NH_3$ | | | | | | 4 | 4 | 20 | 20 | 20 | | | | |
| $H_2S$ | | | | | | | | 14 | 14 | | | | | |
| Light hydrocarbons | 300 | | 300 | 150 | 150 | | | 275 | 185 | 185 | 90 | 90 | 90 | |
| $(NH_4)_2HPO_4$ | | 70 | | | | | | | | | | | | |
| $CH_4$ | | | | | | 67 | 67 | 137 | 132 | 132 | 5 | 5 | 5 | |
| $H_2$ | | | | | | 66 | 67 | 115 | 114 | 114 | 1 | 1 | 1 | |
| Oil-insolubles | | | 128 | 128 | | | | | | | | | | |
| Diatomaceous earth | | | | 70 | | | | | | | | | | |

*Present in combined form in the used oil.
**Present in combined form in the used oil, excluding $H_2O$.

As used herein, the term "flash distillation" is meant to represent distillation in which all or substantially all of the heat used to convert liquid to vapor in the distillation process is provided as sensible heat to the mixture comprising the liquid while the mixture is under a given pressure, with vaporization of liquid subsequently occuring upon reduction in pressure. Thus, "flash distillation" is employed in the process of FIG. 1 in the removal of water and light hydrocarbons from the mixture which leaves contactor 5. As used herein, the term "distillation" is meant to represent that process wherein at least the major amount of heat required to convert liquid to vapor is applied to the mixture comprising the liquid while the mixture is substantially at the pressure at which vaporization occurs. Thus, "distillation" is employed in the process of FIG. 2 in the removal of water and light hydrocarbons from contactors 109 and 116.

Resonable variations and modifications are possible within the scope of the foregoing disclosure, the drawings, and the appended claims of the invention, the essence of which is that there has been provided a method for treating used lubricating oil so as to produce an intermediate product of reduced ash content and a final lube oil stock.

We claim:

1. A process for the production of an essentially pure lube oil stock from a used lubricating oil containing ash-forming and additive components which comprises:

(a) contacting said used lubricating oil with an aqueous solution of a treating agent consisting essentially of an ammonium salt selected from the group consisting of ammonium sulfate, ammonium bisulfate, ammonium phosphate, diammonium hydrogen phosphate, ammonium dihydrogen phosphate and mixtures thereof, said treating agent being present in an amount at least sufficient to react with essentially all of the metal constituents in said used lubricating oil, wherein said contacting is carried out at a temperature in the range of from 60° to 120° C. and a pressure in the range of 1 atmosphere to 250 psia and wherein said agent is kept in contact with said used lubricating oil for a time sufficient to disperse said agent in said used lubricating oil and to react said agent with essentially all the ash-forming metal components of said used lubricating oil;

(b) removing a major portion of water and light hydrocarbon components from the resulting aqueous reaction mixture from step (a) by maintaining said mixture at a temperature in the range of 110° to 140° C. and a pressure in the range of 5 to 25 psia for a period of time sufficient to effect removal of a major portion of water and light hydrocarbons therefrom;

(c) separating the oil phase from the residual mixture consisting essentially of used lubricating oil and reacted treating agent resulting from step (b) by filtration;

(d) heating the resulting filtered oil from step (c) to a temperature in the range of 200° to 480° C;

(e) contacting the resulting heated oil from step (d) with at least one adsorbent selected from the group consisting of activated carbon, silica gel, clay, bauxite and alumina in a contacting zone;

(f) hydrotreating the resulting oil from step (e) by contacting said oil with hydrogen and a hydrotreating catalyst at a temperature in the range of 200° to 430° C. and at a pressure in the range of 150 to 3000 psia;

(g) stripping the resulting hydrotreated oil from step (f) in a stripping zone maintained at a temperature in the range of about 280° to 395° C. and at a pressure in the range of atmospheric to 50 psia; and thereafter (h) recovering the resulting stripped oil from said stripping zone as a product of the process.

2. A process according to claim 1 wherein the concentration of ammonium salt in said aqueous solution of a treating agent is in the range of 30 to 95 weight percent of that in an aqueous solution at 25° C. saturated with the treating agent.

3. A process according to claim 1 wherein said treating agent is present in an amount such that the ratio of treating agent to used lubricating oil is in the range of 0.002 to 0.05:1.

4. A process according to claim 1 wherein the mixture of step (a) is maintained at the temperature of 60° to 120° C. for a period of time in the range of from 10 to 120 minutes and the mixture of step (b) is maintained at the temperature of 110° to 140° C. for a period of time in the range of from 10 to 120 minutes.

5. A process according to claim 1 wherein a filter aid is added to said used lubricating oil prior to filtration step (c).

6. A process according to claim 5 wherein said filter aid is added in an amount such that the weight ratio of filter aid is up to 0.15:1.

7. A process according to claim 1 wherein said residual mixture of used lubricating oil and reacted treating agent is maintained at a temperature in the range of 60° to 120° C. for a period of at least 10 minutes prior to further processing.

8. A process according to claim 1 wherein the mixture from step (b) is thereafter maintained at a temperature in the range of 140° to 200° C., a pressure in the range of 5 to 25 psia for a time sufficient to effect removal of essentially all remaining water and light hydrocarbons prior to filtration.

9. A process according to claim 1 wherein said adsorbent contains about 0.2 to about 20 weight percent of at least one metal selected from the group consisting of Group VIB and Group VIII metals, weight being based on the total weight modified adsorbent.

10. A process according to claim 1 wherein step (e) is omitted and the hot oil in step (d) is heated to a temperature in the range of 300° to 410° C. in the presence of hydrogen and an adsorbent suspended in the oil, thereafter is cooled to a temperature in the range of 60° to 200° C. and is then refiltered prior to hydrotreating.

11. A process according to claim 1 wherein said stripping step (g) is steam stripping.

12. A process according to claim 1 wherein said stripping step (g) is gas stripping.

* * * * *